US008342000B2

(12) United States Patent
Kuboe

(10) Patent No.: US 8,342,000 B2
(45) Date of Patent: Jan. 1, 2013

(54) SERVO-PRESS MACHINE

(75) Inventor: Kazuhiro Kuboe, Sagamihara (JP)

(73) Assignee: Aida Engineering, Ltd., Kanagawa (JP)

( * ) Notice: Subject to any disclaimer, the term of this patent is extended or adjusted under 35 U.S.C. 154(b) by 983 days.

(21) Appl. No.: 12/357,496

(22) Filed: Jan. 22, 2009

(65) Prior Publication Data

US 2009/0188295 A1 Jul. 30, 2009

(30) Foreign Application Priority Data

Jan. 25, 2008 (JP) ..... 2008-14599

(51) Int. Cl.
*B21D 37/00* (2006.01)
*B30B 15/26* (2006.01)
*B21J 13/02* (2006.01)

(52) U.S. Cl. ..... 72/441; 72/14.8; 72/17.2; 72/20.1; 72/443; 72/446; 100/207; 100/281

(58) Field of Classification Search ..... 72/14.8, 72/17.2, 19.8, 20.1, 21.4, 441, 443, 446; 100/35, 43, 207, 281
See application file for complete search history.

(56) References Cited

U.S. PATENT DOCUMENTS

| | | | | |
|---|---|---|---|---|
| 6,619,088 | B1 * | 9/2003 | Oyamada et al. | 72/17.2 |
| 7,434,505 | B2 * | 10/2008 | Suzuki et al. | 100/43 |
| 7,752,878 | B2 * | 7/2010 | Schmeink | 72/29.2 |
| 7,963,141 | B2 * | 6/2011 | Nagai et al. | 72/345 |
| 8,096,233 | B2 * | 1/2012 | Kaneko | 100/35 |

FOREIGN PATENT DOCUMENTS

| | | | |
|---|---|---|---|
| EP | 2002 969 | A2 | 10/2007 |
| EP | 2002969 | A2 | 12/2008 |
| JP | 2001-352773 | A | 12/2001 |
| JP | 2003-205395 | A | 7/2003 |
| JP | 2004-344946 | A | 12/2004 |
| JP | 2005-261161 | A1 | 9/2005 |
| JP | 2006-192467 | A1 | 7/2006 |
| JP | 2007-282367 | A | 10/2007 |
| SU | 620401 | A1 | 7/1978 |
| SU | 1638028 | A1 | 3/1991 |
| WO | WO 2007/116673 | A1 | 10/2007 |
| WO | WO-2007116673 | A1 | 10/2007 |

OTHER PUBLICATIONS

Notification of Reasons for Refusal—Japanese Application No. 2008-014599—which was mailed on Mar. 21, 2012, which corresponds to this present application.
An Extended European Search Report, which was completed on Jul. 12, 2012 during the prosecution of EP Application No. 09 00 0948, which corresponds to this present application.
European Search Report issued in European Patent Application No. 09000948.1 dated Jul. 20, 2012.

* cited by examiner

*Primary Examiner* — David B Jones
(74) *Attorney, Agent, or Firm* — McDermott Will & Emery LLP

(57) ABSTRACT

A servo-press machine determining whether or not a drive power supply voltage between a positive power supply path and a negative power supply path that connect a power supply device and a motor rotation control section is lower than an induced voltage of a servomotor, and correcting speed-related data based on slide motion information when the servo-press machine has determined that the drive power supply voltage is lower than the induced voltage.

18 Claims, 6 Drawing Sheets

SERVO-PRESS MACHINE

CROSS-REFERENCE TO RELATED APPLICATION

The present application claims priority under 35 U.S.C. §119 to Japanese Patent Application No. 2008-14599, filed Jan. 25, 2008. The content of the application is incorporated herein by reference in its entirety.

BACKGROUND OF THE INVENTION

The present invention relates to a servo-press machine that includes a drive power supply capacitor, drives a servomotor based on slide motion information, and performs a press-forming operation while converting the rotational motion of the servomotor into a vertical movement of a slide through a slide drive mechanism.

A press machine that utilizes a servomotor allows the user to easily set or select slide motion (e.g., JP-A-2003-205395). Specifically, the slide speed can be arbitrarily changed. Moreover, the slide can be stopped temporarily, and the slide motion can be reversed by reversing the rotation of the servomotor. Therefore, adaptability to press-formed products can be increased, and high-quality products can be produced.

In such a servo-press machine, a motor rotation control section controls the rotation of the servomotor based on slide motion information (motion instruction signal) set in advance. A slide drive mechanism receives rotation power generated by rotating the motor to drive the slide. As the slide drive mechanism, an eccentric drive mechanism, a link drive mechanism, and a screw drive mechanism have been known. Among these, the eccentric drive mechanism (crank mechanism or eccentric shaft structure) has been generally employed from the viewpoint of the structure or the function. The slide motion information is created as a slide position corresponding to each stroke (time or angle).

FIG. 6 shows the case of using a crank mechanism. The slide position moves downward from the top dead center (position Pu) toward the bottom dead center (position Pl) along a path Rsp (i.e., slide motion information), and then moves upward toward the top dead center. The slide speed is indicated by a path Rsv.

Specifically, the slide starts to move downward at a time t0 (0.0 sec) on the horizontal axis. The slide speed is reduced immediately before a time t1 in order to achieve a soft touch. The motor torque (path Rmt) thus decreases. A forming area (time t1 to t2) then occurs. The bottom dead center is reached at a time t2, and the top dead center is reached at a time t3 (about 3.6 sec). Specifically, one stroke (production cycle) is 3.6 sec.

The motor rotational speed corresponding to the slide motion (path Rsp) shown in FIG. 6 is indicated by a path Rmr. For example, when performing a deep-drawing operation, the motor is driven at low speed in order to improve the quality. The motor is accelerated immediately after completion of forming (after the time t2) along an acceleration path Rmrin to reach a high speed (allowable maximum rotational speed Mrh).

As a measure to improve speed controllability, a device that accurately estimates the load inertia that changes during operation by calculations or the like and automatically corrects a speed control constant has been proposed (JP-A-2001-352773).

The motor torque (path Rmt) rapidly increases from the minimum value up to the time t1 at which a forming load (load) occurs to reach the forming maximum motor torque Tmh. The motor torque is reduced after completion of forming (time t2). The motor torque is then increased by a torque necessary for accelerating the rotational speed. The allowable maximum motor torque Tms indicated by a bold dotted line indicates the allowable maximum motor torque of the servomotor during forming. The capacity of the servomotor and the capacity of the motor rotation control section including a position/speed control section, a current control section, and the like are selected corresponding to the allowable maximum motor torque.

A motor drive power supply device that generates a drive power supply voltage (direct-current) based on a power supply voltage (alternating-current) has been known (e.g., JP-A-2007-282367). This type of power supply device is generally used as a power supply device of a servo-press machine. In FIG. 7, a power supply device 110 includes a rectifier circuit, a switching circuit, and the like, and generates a drive power supply voltage (direct-current) based on a power supply voltage (alternating-current) input from a power supply system 100. The power supply device 110 and a current control section 33 (that forms part of a motor rotation control section) are connected through positive and negative power supply paths 120. A capacitor 130 is connected between the positive power supply path P and the negative power supply path N. The drive current is supplied from the current control section 33 to a servomotor 7.

The load (torque Rmt) of the servo-press machine increases in the forming area (time t1 to t2), and decreases in the vertical movement areas before and after the forming area, as described above. A change in load of the servo-press machine is very large as compared with other industrial machines. Specifically, a change in load within one production cycle (one slide stroke) is large. Therefore, the capacitance of capacitor 130 is relatively large in order to achieve a drive power supply voltage (voltage Vpn) smoothing function and a buffer (capacitor) function. The capacitance of the capacitor is carefully studied and appropriately selected from the viewpoint of reducing the capacities of the power supply device 110 and the power supply system 100 and reducing cost. Specifically, the capacitor 130 discharges a large amount of power (drive power supply voltage) during forming and supplies the drive power supply voltage to the current control section 33. The induced voltage of the servomotor 7 is indicated by Vm.

When performing a high-quality forming operation, the slide speed Rsv is relatively reduced in the forming area. The slide speed is increased as much as possible over the entire area from the viewpoint of improving the productivity. Specifically, the operator performs a press-forming operation while selecting various types of slide motion (path Rsp) in a production site. However, the slide motion is not selected taking into consideration the relationship among the capacities and the characteristics of the motor rotation control section 33, the servomotor 7, the power supply system 100, the power supply device 110, the capacitor 130, and the like.

Specifically, a mismatch between the selected or set slide motion and the device functions and characteristics results in an unstable operation. Moreover, such an unstable operation may or may not occur depending the experience and the skill of the operator. Specifically, the causes of unstable operation may not be determined.

Therefore, a situation in which the operation must be stopped or the device malfunctions or breaks may occur. This results in a decrease in productivity and an increase in production cost.

SUMMARY

According to an aspect of the invention, there is provided a servo-press machine that includes a capacitor connected between a positive power supply path and a negative power supply path that connect a power supply device and a motor rotation control section, rotationally drives a servomotor based on slide motion information while supplying a drive power supply voltage, and performs a press-forming operation while converting rotational motion of the servomotor into a vertical movement of a slide through a slide drive mechanism.

The servo-press machine determines whether or not a drive power supply voltage between the positive power supply path and the negative power supply path is lower than an induced voltage of the servomotor, and corrects speed-related data based on the slide motion information when the servo-press machine has determined that the drive power supply voltage is lower than the induced voltage.

According to another aspect of the invention, there is provided a servo-press machine that includes a capacitor connected between a positive power supply path and a negative power supply path that connect a power supply device and a motor rotation control section, rotationally drives a servomotor based on slide motion information while supplying a drive power supply voltage, and performs a press-forming operation while converting rotational motion of the servomotor into a vertical movement of a slide through a slide drive mechanism. The servo-press machine includes:

A drive power supply voltage calculation means that calculates a drive power supply voltage between the positive power supply path and the negative power supply path by utilizing the slide motion information. An induced voltage calculation means that calculates an induced voltage of the servomotor by utilizing the slide motion information. A low-voltage state determination means that determines whether or not the calculated drive power supply voltage at a predetermined timing is lower than the calculated induced voltage corresponding to the drive power supply voltage. A correction instruction output means that outputs a correction instruction for speed-related data contained in the slide motion information when the low-voltage state determination means has determined that the calculated drive power supply voltage is lower than the calculated induced voltage.

According to yet another aspect of the invention, there is provided a servo-press machine that includes a capacitor connected between a positive power supply path and a negative power supply path that connects a power supply device and a motor rotation control section, rotationally drives a servomotor based on slide motion information while supplying a drive power supply voltage, and performs a press-forming operation while converting rotational motion of the servomotor into a vertical movement of a slide through a slide drive mechanism. The servo-press machine includes a drive power supply voltage detection means that detects a drive power supply voltage between the positive power supply path and the negative power supply path. An induced voltage detection means that detects an induced voltage of the servomotor. Allow-voltage state determination means that determines whether or not the detected drive power supply voltage at a predetermined timing is lower than the detected induced voltage corresponding to the detected drive power supply voltage. correction control means that automatically corrects speed-related data contained in the slide motion information when the low-voltage state determination means has determined that the detected drive power supply voltage is lower than the detected induced voltage.

DETAILED DESCRIPTION OF THE INVENTION

The invention may provide a servo-press machine that can make corrections for removing causes of unstable operation before operation. The invention may also provide a servo-press machine that can automatically make corrections for removing causes of unstable operation during operation.

Figure 6:
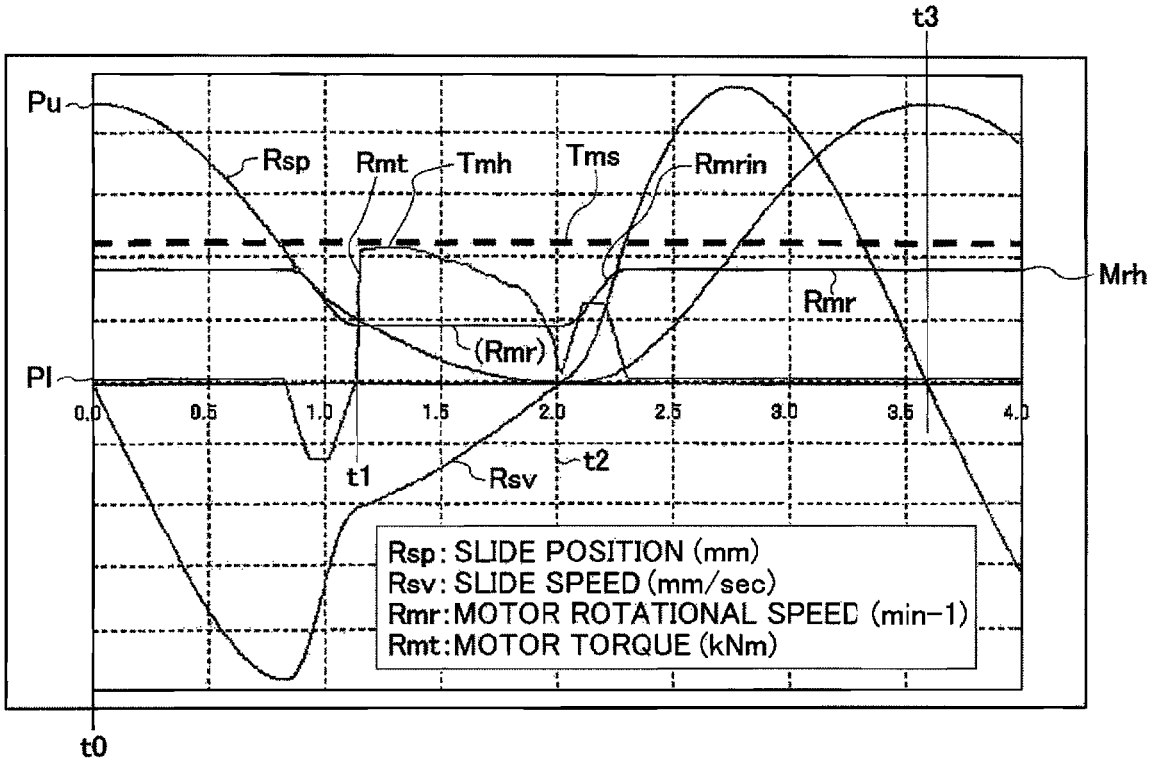
FIG. 6 is a timing chart for describing a related-art example.
Figure 7:
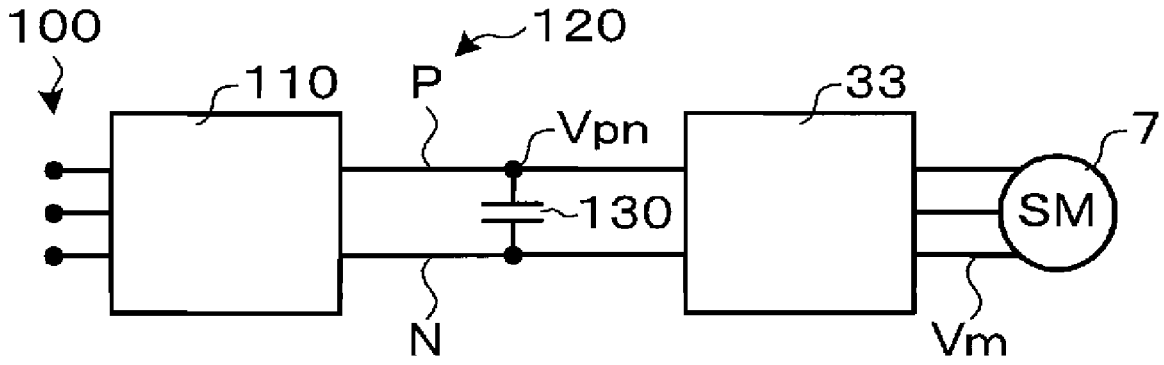
FIG. 7 is a block diagram for describing a power supply device according to a related-art example.

When analyzing unstable operations that occurred in a production site, unstable operations tend to occur when it is desired to achieve high-quality forming while improving the productivity. For example, an early acceleration operation that increases the slide speed (motor rotational speed: path Rmr) in an early stage in the forming area (time t1 to t2) shown in FIG. 6 is performed from a time when effects on quality have been reduced. For example, the allowable maximum rotational speed Mrh is caused to be reached in an early stage by advancing the increase start time of the acceleration path Rmrin. However, since the specifications and characteristics of the servomotor 7, the current control section 33, the power supply device 110, and the capacitor 130 are fixed, the followability is limited. As a result, a voltage reversal phenomenon occurs.

Specifically, the current control section 33 supplies a drive current for generating a motor torque (path Rmt) including an acceleration torque to the servomotor 7 from the time t1. Since the drive power is covered by power discharged from the capacitor (battery) 130, the amount of charge stored in the capacitor 130 decreases so that the drive power supply voltage Vpn gradually decreases. The drive power supply voltage Vpn gradually increases after forming (time t2) (i.e. the forming torque is removed). On the other hand, the induced voltage Vm of the servomotor 7 increases along with an increase in motor rotational speed (path Rmr).

Therefore, the power supply device utilizing the discharge output from the capacitor (battery) 130 undergoes a voltage reversal phenomenon (Vm>Vpn) in which the induced voltage Vm exceeds the drive power supply voltage Vpn in an area in which the slide speed (motor rotational speed) is high.

Specifically, the drive power supply voltage may become insufficient (mismatch) depending on the slide motion setting such as the slide speed and the motor rotational speed. This causes an unstable operation. However, it is hard for the operator to investigate and eliminate the causes of the unstable operation. The invention can eliminate an unstable operation by manually or automatically correcting the slide motion information.

According to an embodiment of the invention, there is provided a servo-press machine that includes a capacitor connected between a positive power supply path and a negative power supply path that connect a power supply device and a motor rotation control section, rotationally drives a servomotor based on slide motion information while supplying a drive power supply voltage, and performs a press-forming operation while converting rotational motion of the servomotor into a vertical movement of a slide through a slide drive mechanism, the servo-press machine determining whether or not a drive power supply voltage between the positive power supply path and the negative power supply path is lower than an induced voltage of the servomotor, and correcting speed-related data based on the slide motion information when the servo-press machine has determined that the drive power supply voltage is lower than the induced voltage.

According to this embodiment, causes of unstable operation can be removed before or during operation. Therefore, a smooth and stable press operation can be achieved while improving the productivity.

According to an embodiment of the invention, there is provided a servo-press machine that includes a capacitor connected between a positive power supply path and a negative power supply path that connect a power supply device and a motor rotation control section, rotationally drives a servomotor based on slide motion information while supplying a drive power supply voltage, and performs a press-forming operation while converting rotational motion of the servomotor into a vertical movement of a slide through a slide drive mechanism. The servo-press machine has a drive power supply voltage calculation means that calculates a drive power supply voltage between the positive power supply path and the negative power supply path by utilizing the slide motion information. An induced voltage calculation means that calculates an induced voltage of the servomotor by utilizing the slide motion information. A low-voltage state determination means that determines whether or not the calculated drive power supply voltage at a predetermined timing is lower than the calculated induced voltage corresponding to the drive power supply voltage. A correction instruction output means that outputs a correction instruction for speed-related data contained in the slide motion information when the low-voltage state determination means has determined that the calculated drive power supply voltage is lower than the calculated induced voltage.

According to this embodiment, corrections for removing causes of unstable operation can be performed before operation. Therefore, a smooth and stable press operation with simple handling can be achieved.

According to an embodiment of the invention, there is provided a servo-press machine that includes a capacitor connected between a positive power supply path and a negative power supply path that connect a power supply device and a motor rotation control section, rotationally drives a servomotor based on slide motion information while supplying a drive power supply voltage, and performs a press-forming operation while converting rotational motion of the servomotor into a vertical movement of a slide through a slide drive mechanism. The servo-press machine includes a drive power supply voltage detection means that detects a drive power supply voltage between the positive power supply path and the negative power supply path. An induced voltage detection means that detects an induced voltage of the servomotor A low-voltage state determination means that determines whether or not the detected drive power supply voltage at a predetermined timing is lower than the detected induced voltage corresponding to the detected drive power supply voltage.

A correction control means that automatically corrects speed-related data contained in the slide motion information when the low-voltage state determination means has determined that the detected drive power supply voltage is lower than the detected induced voltage.

According to this embodiment, corrections for removing causes of unstable operation can be automatically performed during operation. Therefore, a smooth and stable press operation can be achieved while further facilitating handling.

The above-described servo-press machines can correct the speed-related data by reducing the induced voltage to a value lower than the drive power supply voltage.

The above-described servo-press machines can correct the speed-related data by reducing a rotational speed of the servomotor.

The above-described servo-press machines can correct the speed-related data by reducing an acceleration rate of a rotational speed of the servomotor.

The above-described servo-press machines can correct the speed-related data by delaying an acceleration start time of a rotational speed of the servomotor.

The above-described servo-press machines can correct the speed-related data by decelerating a rotational speed of the servomotor.

As shown in FIGS. 1 to 4, a servo-press machine 1 according to an embodiment of the invention includes a drive power supply voltage calculation means, an induced voltage calculation means, and a low-voltage state determination means that utilize a CPU 21, a nonvolatile memory 22, and a memory 23 that can retain data even when power has been removed, and a correction instruction output means that utilizes the CPU 21, the nonvolatile memory 22, the memory 23, and a display section 26, and outputs a correction instruction for speed-related data contained in slide motion information when the servo-press machine 1 has determined that a calculated drive power supply voltage Vpn is lower than a calculated induced voltage Vm.

Specifically, the servo-press machine 1 can determine whether or not the drive power supply voltage Vpn between positive and negative power supply paths 120 (P and N) is lower than the induced voltage Vm of a servomotor 7, and can correct speed-related data based on the slide motion information when the servo-press machine 1 has determined that the drive power supply voltage Vpn is lower than the induced voltage Vm. This makes it possible to set the drive power supply voltage Vpn to be higher than the induced voltage Vm.

The servo-press machine 1 includes a capacitor 130 that is connected between the positive power supply path P and the negative power supply path N that connect a power supply device 110 and a motor rotation control section 30 (including a current control section 33). The servo-press machine 1 rotationally drives the servomotor 7 based on the slide motion information while supplying a drive power supply voltage, and performs a press-forming operation while converting the rotational motion of the servomotor into a vertical movement of the slide through a slide drive mechanism.

Figure 1:
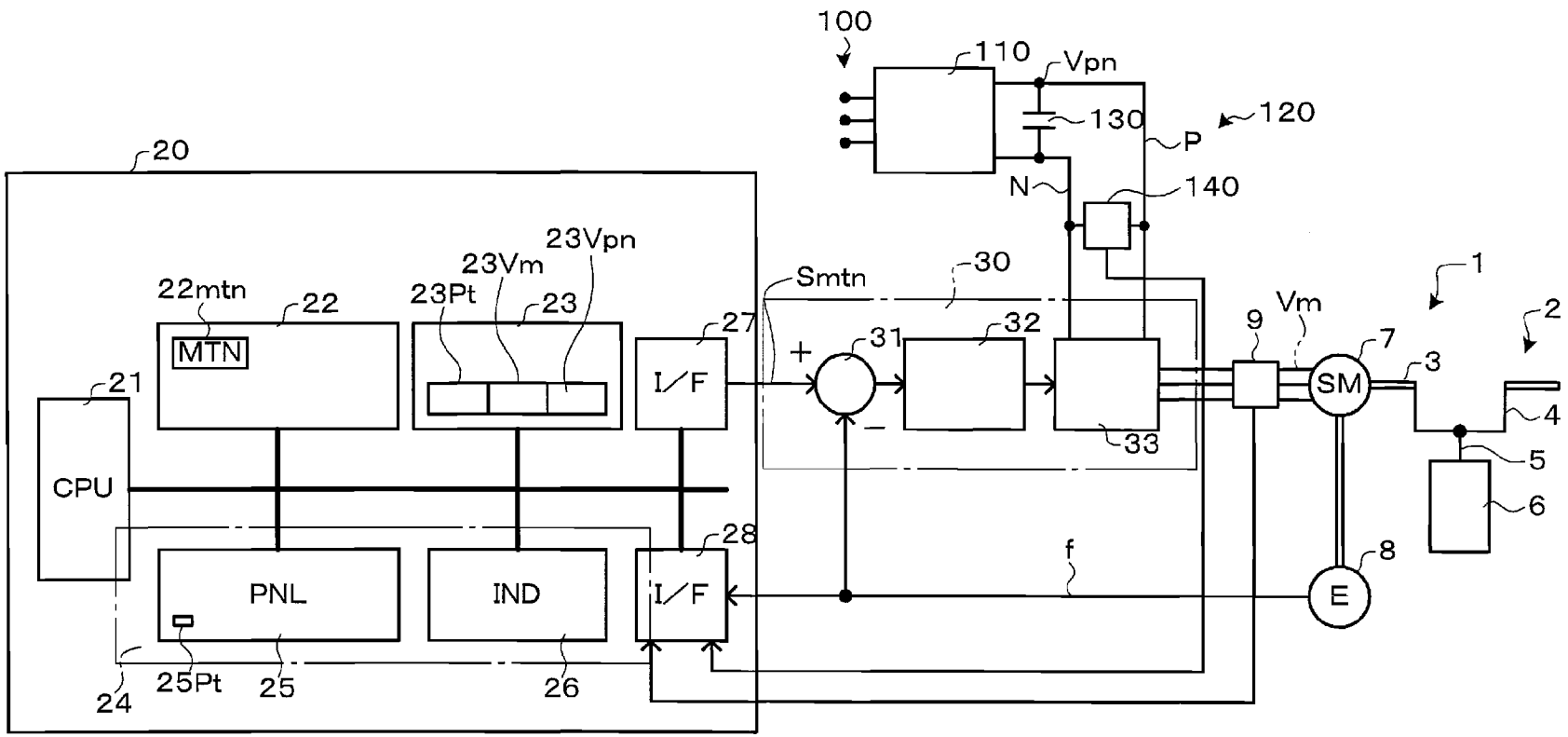
FIG. 1 is a block diagram for describing an embodiment of the invention.
Figure 2:
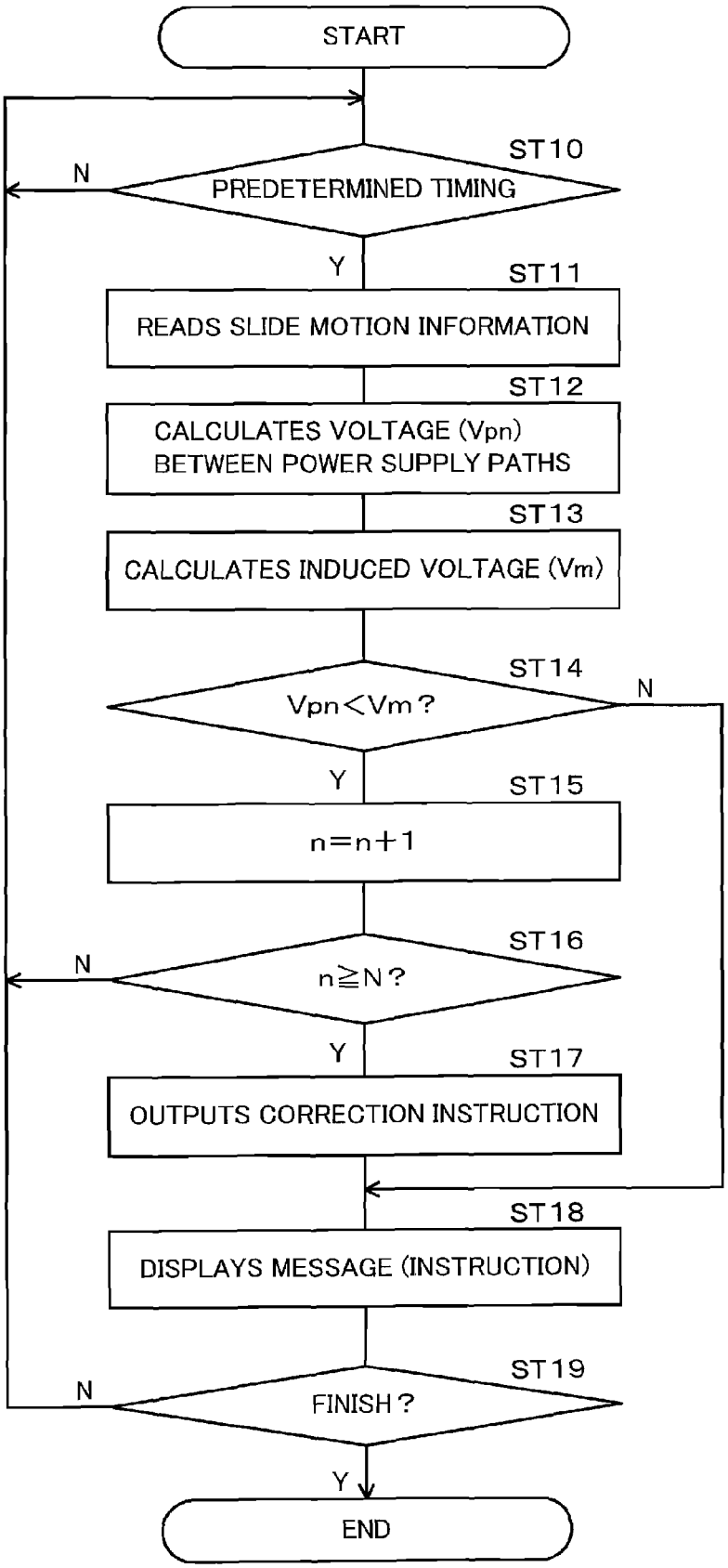
FIG. 2 is a flowchart for describing operations according to an embodiment of the invention.

In FIG. 1, the slide drive mechanism is formed of a crank mechanism (eccentric drive mechanism) 2 including a crank shaft 3 (crank section 4). The reversible rotation (forward rotation and reverse rotation) of the crank shaft 3 can be controlled by controlling the rotation of the alternating-current (AC) servomotor 7 that is rotatably supported by and directly connected to a bearing. The servomotor 7 may be a direct-current (DC) servomotor or a reactance motor.

The crank shaft 3 and the servomotor 7 may be connected indirectly through a gear (speed reducer). A higher pressure can be applied by using the gear (speed reducer). The eccentric drive mechanism may be an eccentric shaft structure.

The slide 6 is attached to a frame main body so that the slide 6 can slide vertically. The slide 6 engages a balance device. The slide 6 can be driven vertically through a connecting rod 5 by rotating the crank shaft 3. The top dead center is a position Pu shown in FIGS. 3 and 4, and the bottom dead center is a position PI. A die includes an upper die on the side of the slide 6 and a lower die on the side of a bolster (not shown).

An encoder 8 connected to the AC servomotor 7 includes a number of optical slits and an optical detector in principle, and outputs a rotational angle (crank angle) theta of the servomotor 7 (crank shaft 3). In this embodiment, the encoder 8 includes a signal converter (not shown) that converts the rotational angle theta (pulse signal) into a vertical position (pulse signal) of the slide 6 and outputs the vertical position of the slide 6.

Voltage detectors 9 and 140 shown in FIG. 1 are described later with reference to another embodiment.

In FIG. 1 that shows the entire configuration of the servo-press machine 1, a press control panel 20 includes the CPU 21, the nonvolatile memory 22 (e.g., ROM and HDD), the memory 23 (e.g., flash RAM) that can retain data even when power has been removed, a touch panel 24 that functions as an operation section 25 and the display section 26, and interfaces 27 and 28, for example. The rotation of the servomotor 7 can be controlled while generating a motion instruction signal Smtn based on a press operation control program stored in the memory 22 and slide motion information MTN and outputting the motion instruction signal to the motor rotation control section 30 so that the slide 6 can be moved in the upward/downward direction. In FIG. 1, items relating to a workpiece transfer device and the like are omitted.

Figure 3:
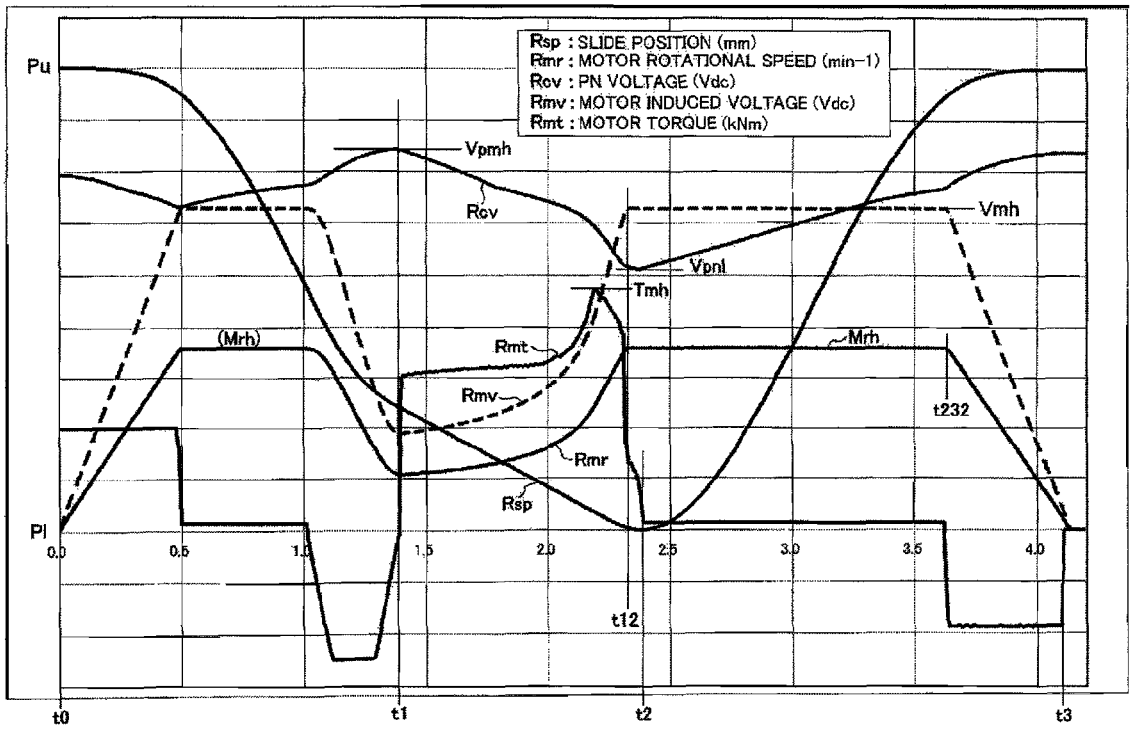
FIG. 3 is a timing chart for describing a state before correction according to an embodiment of the invention.
Figure 4:
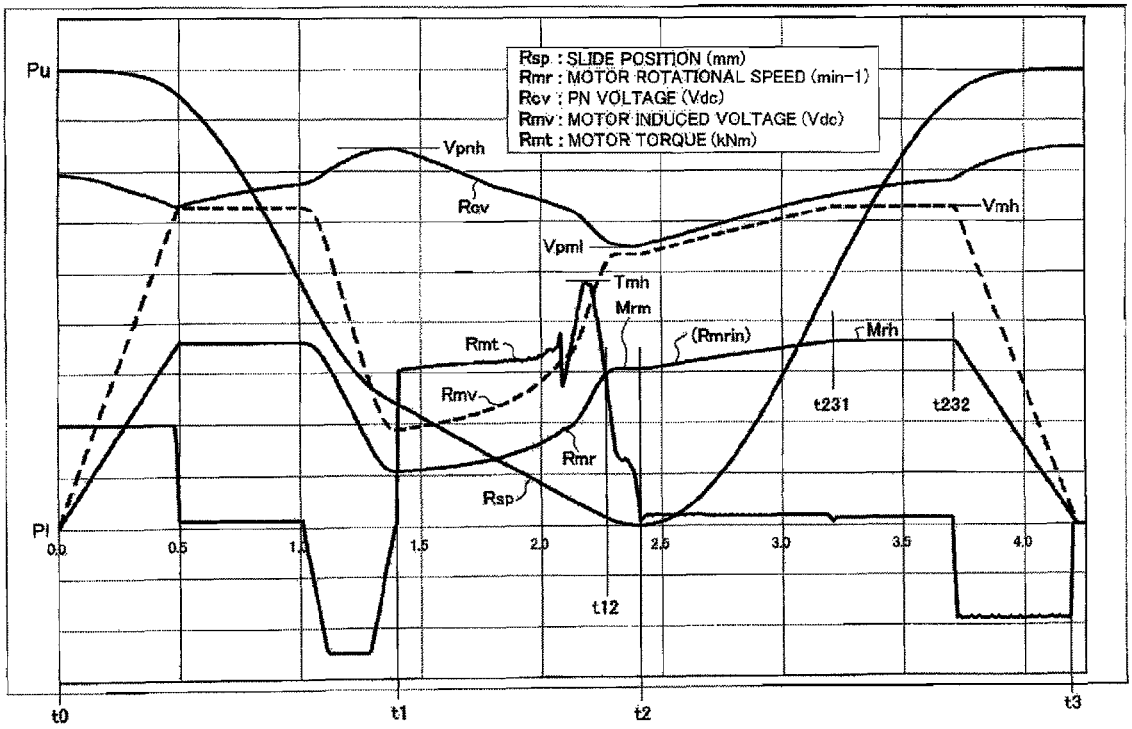
FIG. 4 is a timing chart for describing a state after correction according to an embodiment of the invention.

As shown in FIGS. 3 and 4, the slide motion information MTN (P, t) is slide position information (path Rsp) that indicates the time t and the position P of the slide 6.

The slide motion information MTN can be set and input by using the operation section 25 (e.g., slide position information setting-inputting means 25Pt) shown in FIG. 1. The slide motion information MTN that has been set is stored in a motion information area 22*mtn* of the nonvolatile memory 22 so that the slide motion information MTN can be selectively utilized later. The slide motion information MTN selected before press operation is loaded into the memory 23.

In this embodiment, the slide motion information MTN (P, t) stores motor rotational speed information (path Rmr) shown in FIGS. 3 and 4 that is converted and generated based on the slide position information (path Rsp). The motor rotational speed information (path Rmr) is calculated from slide speed information and the characteristics of the crank mechanism 2. The speed-related data contained in the slide motion information MTN (forming data) refers to slide speed data and motor rotational speed data.

The motion instruction signal Smtn shown in FIG. 1 is generated based on the motor rotational speed data or the motor rotational speed information, and output as a pulse signal, for example. A motion instruction section that utilizes the CPU 21, the nonvolatile memory 22, and the memory 23 that can retain data even when power has been removed has a position pulse output structure.

Specifically, when the desired slide motion information MTN (path Rsp) has been selected or set by using the operation section 25, the motion instruction section outputs the motion instruction signal Smtn to the motor rotation control section 30 based on a press operation control program (motion instruction signal generation/output control program). For example, when the motor rotational speed is 120 RPM, the number of pulses output from the encoder 8 per rotation (360 degrees) is 1,000,000, and the output cycle time is 5 ms, the number of pulses output per cycle (5 ms) is 10,000 (=(1,000,000×120)/(60×0.005)). Specifically, the motor rotational speed may be changed by adjusting or changing the number of pulses in the cycle time.

In the motor rotation control section 30 that has received the motion instruction signal Smtn, a position comparator 31 compares the motion instruction signal Smtn (target value) with the actual slide position signal (feedback signal f) detected by the encoder 8 to generate and output a position deviation signal.

A position control section that forms part of the position/speed control section 32 accumulates the input position deviation signal and multiplies the accumulated position deviation signal by a position loop gain to generate and output a speed signal. A speed comparator compares the speed signal with a speed signal (speed component of the signal f) output from the encoder 8 (speed detector) to generate and output a speed deviation signal. A speed control section that forms part of the position/speed control section 32 multiplies the input speed deviation signal by a speed loop gain to generate a current instruction signal, and outputs the current instruction signal to the current control section (amplifier) 33. The current instruction signal is substantially a motor torque signal.

The current control section 33 generates a phase target current signal by using the drive power supply voltage (voltage Vpn) supplied from the power supply device 110 and the capacitor 130. The current control section 33 also generates and outputs a current deviation signal. A PWM signal is generated from each phase current deviation signal by PWM control and pulse width modulation. Switching (ON/OFF) control is performed by each PWM signal to output phase motor drive currents U, V, and W. The rotation of the servomotor 7 can thus be controlled.

In FIG. 1, the power supply device 110 includes a rectifier circuit, a switching circuit, and the like (converter method). The power supply device 110 generates a direct-current drive power supply voltage based on an alternating-current power supply voltage received from a power supply system 100. The smoothing capacitor 130 is connected between the positive and negative power supply paths 120 (P and N) that connect the power supply device 110 and the current control section 33 using an inverter method. The capacitor 130 is formed by using an electrolytic capacitor. Note that the capacitor 130 is not limited thereto. A large amount of torque generation power during forming is covered by power discharged from the capacitor 130 having a buffer function.

The drive power supply voltage calculation means is formed by the memory 22 that stores a drive power supply voltage calculation control program, the memory 23 into which data is loaded, and the CPU 21 that executes the drive power supply voltage calculation control program. The drive power supply voltage calculation means calculates the drive power supply voltage Vpn between the positive power supply path P and the negative power supply path N by utilizing the slide motion information MTN (path Rsp) (ST12 in FIG. 2). The calculated drive power supply voltage Vpn is stored in a drive power supply voltage data storage means 23Vpn shown in FIG. 1 as drive power supply voltage data that corresponds to the time t.

The drive power supply voltage Vpn is a voltage across the capacitor 130. The drive power supply voltage Vpn decreases when discharging a supply current that corresponds to the torque T generated by the servomotor 7. The torque T applied to the servomotor 7 is the sum of a torque Tj required to rotate an inertia J directly connected to the servomotor shaft, a torque Tm that accelerates the load (e.g., slide), and a torque Tg that supports the gravity G applied to the load. Specifically, the drive power supply voltage Vpn can be calculated from the torque T according to the slide motion information MTN (path Rsp) and a constant (e.g., the capacitance of the capacitor 130) using the time t as a common term.

The induced voltage calculation means is configured in the same manner as the drive power supply voltage calculation means. The induced voltage calculation means calculates the induced voltage of the servomotor 7 by utilizing the slide motion information MTN (e.g., motor speed) (ST13). The calculated induced voltage Vm is stored in an induced voltage data storage means 23Vm as induced voltage data that corresponds to the time t. The time t occurs at a predetermined timing (sampling time). The time t is the same as that when calculating the drive power supply voltage Vpn.

The induced voltage Vm is a value proportional to the rotational speed of the servomotor 7. The induced voltage Vm may be calculated by using the slide speed (i.e., motor rotational speed (path Rmr)) based on the slide motion information MTN and a motor constant (e.g., induced voltage constant and torque constant).

In this embodiment, a forming data storage means 23Pt (predetermined area of the memory 23) may be provided from the viewpoint of convenience of handling and a high-speed process. The slide motion information MTN stored in the motion information area 22*mtn* may be directly stored in the forming data storage means 23Pt, or forming data obtained by converting the slide motion information MTN may be stored (or copied) in the forming data storage means 23Pt. The forming data storage means may also serve as the motion information area 22*mtn.*

The forming data may contain only the slide position (path Rsp). In this embodiment, the forming data contains the slide position (path Rsp) and the motor rotational speed (path Rmr) in the forming area (time t1 to t2) and the subsequent area (time t2 to t232) shown in FIGS. 3 and 4. This aims to speed up and facilitate the speed-related data correction process. The motor torque (path Rmt), the drive power supply voltage Vpn (path Rcv), and the induced voltage Vm (path Rmv) are also stored in the forming data storage means.

The forming data may be displayed on the display section 26 in enlarged graph format (FIGS. 3 and 4). This aims to facilitate the speed-related data (e.g., motor rotational speed (path Rmr) correction process (details are described later). The corrected speed-related data is reflected in the slide motion information MTN stored in the memory 22*mtn*. The subsequent press operation is performed based on the slide motion information MTN in which the corrected speed-related data is reflected.

The low-voltage state determination means determines whether or not the drive power supply voltage Vpn calculated at a predetermined timing (time t) is lower than the calculated induced voltage Vm (i.e., low-voltage state). The low-voltage state determination means is implemented by a step ST14 in FIG. 2. For example, the low-voltage state determination means determines that the state at the time t2 in FIG. 3 is the low-voltage state (YES in ST14). The low-voltage state determination means determines that the state at the time t2 in FIG. 4 is a high-voltage state (NO in ST14). Note that the determination method is not limited thereto. For example, the low-voltage state determination means may determine the low-voltage state or the high-voltage state when a calculated difference (Vcd (=Vm−Vpn)) is equal to or larger than a difference (Vsd) set in advance.

It may be impossible to reliably determine that the voltage reversal phenomenon consecutively occurs based on the previous determination result. In this embodiment, a voltage reversal checking means utilizing the CPU 21, the nonvolatile memory 22, and the memory 23 that can retain data even when power has been removed is provided. The voltage reversal checking means counts the number of times (count value) n that the low-voltage state determination means has determined that the low-voltage state has occurred (ST15), and determines that the voltage reversal phenomenon has occurred when the count value n is equal to or larger than a number N set in advance. This also applies to the case of using the above-mentioned difference comparison determination method.

The correction instruction output means outputs the correction instruction for the speed-related data based on the slide motion information MTN when the low-voltage state determination means has determined that the calculated drive power supply voltage Vpn is lower than the calculated induced voltage Vm (YES in ST14). The correction instruction output means is formed by the CPU 21, the nonvolatile memory 22, the memory 23, and the display section 26. The correction instruction output means is implemented by steps ST17 and ST18 in FIG. 2.

The correction instruction is displayed on the display section 26. Note that the correction instruction may be output by using sound or the like.

The speed-related data is corrected by reducing the rotational speed of the servomotor 7 so that the motor induced voltage Vm becomes lower than the drive power supply voltage Vpn, for example. The motor induced voltage Vm may be decreased to a value lower than the drive power supply voltage Vpn by reducing the absolute value of the motor rotational speed, reducing the acceleration rate of the motor rotational speed, or delaying the acceleration start timing of the motor rotational speed without changing the acceleration rate of the motor rotational speed. The motor rotational speed may be temporarily decelerated depending on the situation. The above-mentioned method increases the time required to increase the motor rotational speed to the allowable maximum speed Mrh shown in FIGS. 3 and 4.

In this embodiment, the slide motion information MTN is set by using the setting-inputting means 25Pt before trial or the press operation. For example, the slide motion information MTN is set as the slide position P at each time t. The discontinuous information that has been set is displayed on the display section 26 as a continuous path Rsp (see FIG. 3). Motor rotational speed information (path Rmr) and motor torque information (path Rmt) corresponding to the slide motion information MTN are automatically generated (converted), displayed, and stored in the memory 23Pt. The motor rotational speed information and the motor torque information are also stored in the memory 22*mtn*. The slide motion information MTN is similarly displayed when selecting the slide motion information MTN stored in the memory 22*mtn.*

In FIG. 3, the slide motion information MTN currently created is configured so that the slide 6 moves downward from the top dead center Pu (time t0) at high speed, is reduced in speed so that a soft touch occurs at the time t1 (about 1.4 sec), and reaches the bottom dead center PI at the time t2 (about 2.4 sec) after the forming area (time t1 to t2). The slide 6 then moves upward at high speed, and reaches the top dead center Pu at the time t3 (about 4.1 sec). The slide 6 moves upward and downward outside the forming area at the allowable maximum speed Mrh of the servomotor 7 excluding the acceleration step and the deceleration step.

In order to improve the productivity on the assumption that the forming quality is satisfied, the slide speed (i.e., the motor rotational speed) is increased immediately after the time t1, and reaches the allowable maximum speed Mrh immediately before the time t2 (time t12). The acceleration time is 0.9 sec from the time t1 (about 1.4 sec) to the time t12 (about 2.3 sec).

The allowable maximum speed Mrh is maintained up to the time t232 (about 3.6 sec). Specifically, the slide motion information MTN has been created (selected) so that the production cycle (time t0 to t3) is 4.1 sec.

In this stage, three pieces of information (path Rsp, path Rmr, and path Rmt) are displayed on the display section 26. When a stability diagnosis instruction has been issued, a read control means that utilizes the CPU 21, the nonvolatile memory 22, and the memory 23 that can retain data even when power has been removed reads the slide motion information MTN at a predetermined timing (YES in ST10 in FIG. 2) (ST11). The drive power supply voltage calculation means calculates the drive power supply voltage Vpn, and the induced voltage calculation means calculates the induced voltage Vm (ST12 and ST13).

The calculated drive power supply voltage Vpn and the calculated induced voltage Vm are displayed in comparative form (path Rcv and path Rmv shown in FIG. 3). In FIG. 3, the voltage reversal phenomenon in which the induced voltage Vm is equal to or higher than drive power supply voltage Vpn occurs from a time immediately before a time t12. However, the voltage reversal phenomenon may be overlooked by naked-eye determination.

Therefore, the low-voltage state determination means determines that the drive power supply voltage Vpn at a time T1 contained in the drive power supply voltage data (path Rcv) is lower than the corresponding induced voltage Vm contained in the induced voltage data (path Rmv) (YES in ST14). The voltage reversal checking means then operates immediately. Specifically, the current YES determination count is added to the count value n (ST15).

When the count value n is equal to or larger than N (i.e., the low-voltage state has successively occurred N times) (YES in ST16), the correction instruction output means outputs the correction instruction for the slide motion information MTN (e.g., speed-related data) (ST17 and ST18).

The correction instruction is displayed on the display section 26 to attract attention. For example, a message "Reduce the slide speed to remove causes of instability." is displayed (ST18).

When the low-voltage state determination means has determined that the drive power supply voltage Vpn is higher than the induced voltage Vm contained in the induced voltage data (high-voltage state (i.e., normal state)) (NO in ST14), a message "A stable operation can be performed." is displayed, for example (ST18).

The program is finished when the operator has issued a finish instruction (finish operation) (YES in ST19). The finish operation is performed by using a key provided in the operation section 25. The statement "program is finished" means that the process is prevented from returning to the step ST10. Note that the latest graph and message may be continuously displayed on the display section 26.

The operator who has been notified of the correction instruction by display determines the problem and measures (i.e., corrections). In FIG. 3, the motor rotational speed (path Rmr) starts to increase immediately after the time t1. The acceleration rate is increased when about two seconds has elapsed, and the motor rotational speed reaches the allowable maximum speed Mrh at the time t12. Since such a rapid motor acceleration increases the acceleration torque Tm, the load (motor torque T) rapidly increases. The motor torque information is indicated by the path Rmt that has the maximum motor torque Tmh as a vertex, and rapidly decreases from the time t12.

Therefore, the drive power supply voltage Vpn (path Rcv) reaches the maximum voltage Vpnh at the time t1 (about 1.4 sec). The drive power supply voltage Vpn decreases (is attenuated) in inverse proportion to the motor torque (path Rmt) in the forming (load) area. The drive power supply voltage Vpn rapidly decreases after the acceleration rate has been increased and the maximum motor torque Tmh has been generated. Specifically, since the amount of power supplied from the capacitor 130 to the servomotor 7 rapidly increases, the drive power supply voltage Vpn rapidly decreases to the minimum voltage Vpnl.

When the motor rotational speed (path Rmr) that has been gradually increased immediately after the time t1 is rapidly increased after about 2.0 sec has elapsed, the induced voltage Vm (path Rmv) rapidly increases in proportion to the motor rotational speed, and reaches the maximum voltage Vmh at the time t12 (about 2.3 sec). Specifically, the voltage reversal (Vpn<Vm) phenomenon occurs immediately before the time t12.

Specifically, when using the slide motion information MTN (e.g., path Rsp and path Rmr) that has been set or selected so that the production cycle is 4.1 sec (=t3−t0), the time (time t1 to t12) required for the allowable maximum speed Mrh to be achieved is too short.

Therefore, the operator changes the forming data (speed-related data) stored in the forming data storage means 23Pt (22*mtn*) by using the slide position information setting-inputting means 25 Pt (forming data input means) in order to remove causes of instability. The operator reduces the motor rotational speed.

This is implemented by changing the speed-related data contained in the slide motion information MTN (e.g., the position P of the slide 6 with respect to the time t). The corrected motor rotational speed (path Rmr) is automatically generated (converted) to correspond to the corrected path Rsp. This also applies to the motor torque (path Rmt). The correction result is reflected in the slide motion information MTN stored in the memory 22*mtn* (i.e., the slide motion information MTN is partially corrected).

As shown in FIG. 4, the motor rotational speed at the time t12 (about 2.25 sec) is reduced to a value (e.g., Mrm (=Mrh× 0.8)) lower than the allowable maximum speed Mrh. The acceleration rate is reduced from the time t1 (about 1.4 sec) to the time t2 (about 2.4 sec) as compared with the acceleration rate shown in FIG. 3 (before correction). A constant speed (low speed Mrm) is maintained from the time t12 to the time t2. Specifically, a constant speed period is provided.

The acceleration rate (path Rmrin) is further reduced from the time t2 to the time 231 (about 3.2 sec) so that the allowable maximum speed Mrh is reached at the time 231. The allowable maximum speed Mrh is maintained up to the time t232 (about 3.7 sec).

As a result, the causes of instability can be eliminated without reducing the target production cycle (t3=4.1 sec) shown in FIG. 3 to a large extent. The corrected production cycle is t3=4.2 sec (see FIG. 4). Specifically, a smooth and stable press operation can be ensured by reducing the production cycle by about 2%. This method eliminates the disadvantage of the related-art example (i.e., an economical burden required to change the specifications and characteristics of the servomotor 7, the current control section 33, the power supply device 110, and the capacitor 130, and a long shutdown period required to replace the devices).

The operator again issues the stability diagnosis instruction in order to check the validation of the correction process. The drive power supply voltage Vpn and the induced voltage Vm are then calculated (ST12 and ST13), and the path Rsp, the path Rmr, and the path Rmt based on the partially corrected slide motion information MTN are displayed. The drive power supply voltage Vpn and the induced voltage Vm (paths Rcv and Rmv) are also displayed on the display section 26 (see FIG. 4). This enables the operator to visually check that the corrected drive power supply voltage Vpn is not lower than the induced voltage Vm at each time t.

For example when the low-voltage state remains at a time t after the first correction process, the second or subsequent correction process and the check process are repeated. When it is desired to increase the difference between the drive power supply voltage Vpn and the induced voltage Vm (Vpn−Vm) (voltage allowance operation), or it is desired to decrease the difference between the drive power supply voltage Vpn and the induced voltage Vm (productivity increasing operation), the correction process and the check process can also be repeated.

Therefore, the voltage reversal phenomenon can be completely eliminated by bringing the production cycle (time t0 to t3) shown in FIG. 4 (after correction) closer (e.g., 4.15 sec) to the production cycle (about 4.1 sec) shown in FIG. 3 (before correction).

According to this embodiment, since the speed-related data based on the slide motion information MTN is corrected when the low-voltage state determination means has determined that the drive power supply voltage Vpn is lower than the calculated induced voltage Vm, causes of unstable operation can be eliminated before or during operation. Therefore, a smooth and stable press operation can be achieved while improving the productivity.

Moreover, since the drive power supply voltage calculation means, the induced voltage calculation means, the low-voltage state determination means, and the correction instruction output means are provided, and the correction instruction for the speed-related data (motor rotational speed) contained in the slide motion information MTN can be output when the low-voltage state determination means has determined that the calculated drive power supply voltage Vpn is lower than the calculated induced voltage, corrections that eliminate causes of unstable operation can be performed before operation. Therefore, a smooth and stable press operation with simple handling can be achieved. Moreover, the forming data (speed-related data) can be corrected appropriately and easily.

Since the display section displays that the calculated drive power supply voltage Vpn is lower than the calculated induced voltage Vm, an electrically inexperienced operator can easily determine the situation. As a result, an inexperienced operator can perform a press operation in the same manner as an experienced operator.

Since the voltage reversal checking means is provided, and the calculated drive power supply voltage Vpn is determined to be lower than the calculated induced voltage Vm (i.e., voltage reversal phenomenon) when the low-voltage state has successively occurred N times, reliability can be increased.

Moreover, since the graph and the message are displayed by the correction instruction output means, the operator can be reliably notified of the correction instruction, and can promptly and appropriately determine the details of corrections.

This embodiment is the same as the above embodiment as to the basic configuration and function (FIGS. 1 to 4). However, while the above embodiment is configured so that corrections are made based on the operation of the operator who has watched the correction instruction output display, this embodiment is configured so that corrections are made automatically during operation.

Description of the same items as those of the above embodiment (FIG. 1 and the like) is simplified or omitted.

As shown in FIG. 1, the drive power supply voltage detection means is formed by a voltage detector 140 connected between the positive power supply path P and the negative power supply path N (positive and negative power supply paths 120), and detects the drive power supply voltage Vpn equal to the voltage across the capacitor 130. The drive power supply voltage Vpn detected (ST21) at a predetermined timing (YES in ST20 in FIG. 5) is stored in the drive power supply voltage data storage means 23Vpn of the memory 23 as the drive power supply voltage data that corresponds to the time t.

The induced voltage detection means is formed by a voltage detector 9 provided in a power supply path that connects the current control section 33 and the servomotor 7, and detects the induced voltage Vm of the servomotor 7. The induced voltage Vm detected (ST22) at the same timing (YES in ST20 in FIG. 5) as the drive power supply voltage is stored in the induced voltage data storage means 23Vm of the memory 23 as the induced voltage data that corresponds to the time t. The drive power supply voltage data and the induced voltage data at the time t are common.

The low-voltage state determination means determines whether or not the drive power supply voltage Vpn detected at the predetermined timing (time t) is lower than the detected induced voltage Vm (i.e., low-voltage state) in the same manner as in the above embodiment.

A correction control means operates when the voltage reversal checking means has determined that the low-voltage state has successively occurred N times (i.e., the detected drive power supply voltage Vpn is lower than the detected induced voltage Vm (i.e., voltage reversal phenomenon) (YES in ST25).

Specifically, the correction control means that utilizes the CPU 21, the nonvolatile memory 22, and the memory 23 that can retain data even when power has been removed corrects the slide motion information (speed-related data) when the voltage reversal checking means has determined that the detected drive power supply voltage Vpn is lower than the detected induced voltage Vm (YES in ST23 in FIG. 4) (ST26).

A message display control means that utilizes the CPU 21, the nonvolatile memory 22, and the memory 23 that can retain data even when power has been removed displays an automatic correction item on the display section 26 (ST27) to indicate the details of corrections automatically performed to the operator. For example, a message "The slide motion was partially corrected to remove causes of instability" is displayed.

The message display control means also displays a message "The operation is stable" when the determination result in the step ST23 is NO (ST27).

The program is finished when the operator has issued a finish instruction (finish operation) (YES in ST28). The program may be continuously executed during the press operation.

In this embodiment, when the low-voltage state determination means has determined that the drive power supply voltage Vpn that has been detected (ST21) is lower than the induced voltage Vm that has been detected (ST22) (YES in ST23 and YES in ST25), the correction control means corrects the speed-related data (low-voltage state→high-voltage state) (ST26).

The corrections are the same as the corrections manually made by the operator using the forming data input means 25Pt in the above embodiment, and are automatically performed.

When the high-voltage state is not achieved by one correction, further corrections are performed. This process is repeated automatically.

Specifically, the slide motion information (path Rsp) is corrected so that the difference between the drive power supply voltage Vpn and the induced voltage Vm (Vpn−Vm) is minimized as long as the drive power supply voltage Vpn is lower than the value of induced voltage Vm. Specifically, the slide motion information (path Rsp) is corrected while minimizing the production cycle (time t0 to t3). The automatic correction process has an advantage in that the repetitive operation can be performed promptly and correctly. The productivity can be maximized without increasing the burden on the operator.

The message display control means displays (ST27) the details of corrections on the display section 26 as a message together with the graph shown in FIG. 4. The correction result is reflected in the slide motion information MTN stored in the memory 22*mtn* (i.e., the slide motion information MTN is partially corrected).

According to this embodiment, since the drive power supply voltage detection means 140, the induced voltage detection means 9, the low-voltage state determination means, and the correction control means are provided, and the slide motion information MTN (e.g., speed-related data) can be corrected when the low-voltage state determination means has determined that the drive power supply voltage Vpn at the predetermined timing is lower than the corresponding induced voltage Vm, causes of unstable operation can be automatically eliminated during operation. Therefore, a smooth and stable press operation can be achieved while further facilitating handling.

Moreover, since the voltage reversal checking means is provided, and the voltage reversal phenomenon of the detected drive power supply voltage Vpn and the detected induced voltage Vm is canceled when the low-voltage state has successively occurred N times, an effect of noise or the like can be eliminated. Therefore, reliability can be improved.

This embodiment is the same as the above embodiments as regards the basic configuration and function (FIGS. 1, 3, 4, and 5). However, while the second embodiment is configured so that whether or not the low-voltage state has occurred is determined by comparing the drive power supply voltage detected by the drive power supply voltage detection means and the induced voltage detected by the induced voltage detection means, this embodiment is configured so that whether or not the low-voltage state has occurred is determined by comparing the drive power supply voltage and the induced voltage calculated in the same manner as in the above embodiment, and corrections are made automatically during operation.

Figure 5:
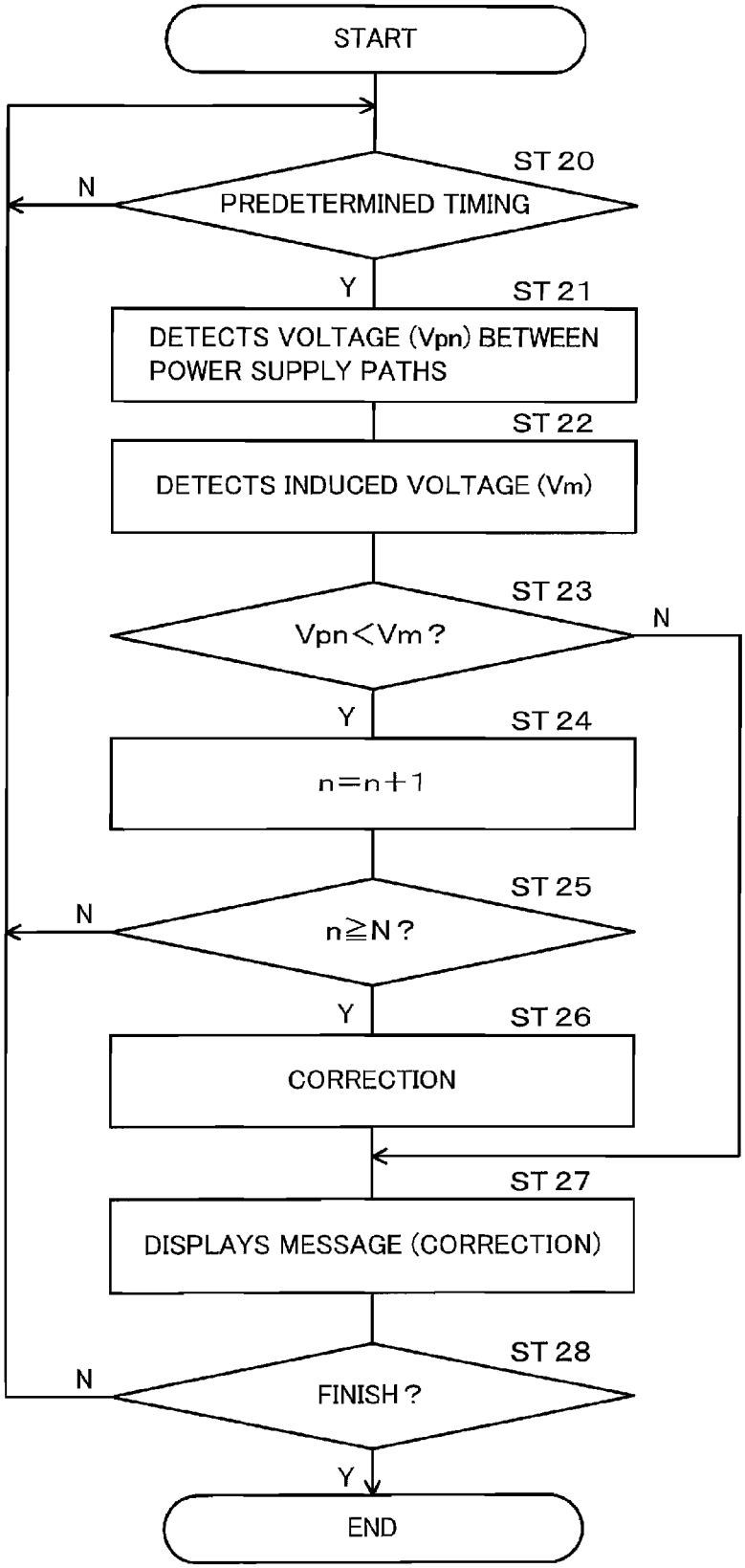
FIG. 5 is a flowchart for describing operations according to another embodiment of the invention.

Description of the same items as those of the above embodiments is omitted. The steps ST21 and ST22 in the embodiment of FIG. 5 are replaced by the steps ST11 and ST12 in the embodiment of FIG. 2.

According to this embodiment, the same effects as those of the above embodiment can be achieved while reducing the hardware load.

Since the invention can remove unstable operation factors before or during operation, the invention ensures a smooth and stable press operation and improves the productivity to a large extent. Therefore, the invention is effective for various types of press forming.

Although only some embodiments of this invention have been described in detail above, those skilled in the art will readily appreciate that many modifications are possible in the embodiments without materially departing from the novel teachings and advantages of this invention. Accordingly, all such modifications are intended to be included within the scope of the invention.

What is claimed is:

1. A servo-press machine comprising:

a slide;

a servomotor for driving the slide for performing a press-forming operation;

a power supply device configured to provide a driving power supply voltage;

positive and negative power supply paths coupled to the power supply device;

a capacitor connected between the positive and negative power supply paths;

a motor rotation control section configured to control the servomotor based on slide motion information and the driving power supply voltage, the slide motion information including information for controlling the servo motor to drive the slide;

a mechanism configured to convert a rotational motion of the servomotor into a linear motion to drive the slide; and a controller configured to obtain information regarding an induced voltage of the servomotor and the drive power supply voltage, determine whether the drive power supply voltage is lower than the induced voltage of the servomotor, and modify the slide motion information when the drive power supply voltage has been determined to be lower than the induced voltage.

2. The servo-press machine as defined in claim 1, wherein the controller modifies the slide motion information for reducing the induced voltage to a value lower than the drive power supply voltage.

3. The servo-press machine as defined in claim 2, wherein the controller modifies the slide motion information for reducing a rotational speed of the servomotor.

4. The servo-press machine as defined in claim 2, wherein the controller modifies the slide motion information for reducing an acceleration rate of the servomotor.

5. The servo-press machine as defined in claim 2, wherein the controller modifies the slide motion information for delaying an acceleration start time of the servomotor.

6. The servo-press machine as defined in claim 2, wherein the controller modifies the slide motion information for decelerating a rotational speed of the servomotor.

7. A servo-press machine comprising:

a slide;

a servomotor for driving the slide for performing a press-forming operation;

a power supply device configured to provide a driving power supply voltage;

positive and negative power supply paths coupled to the power supply device;

a capacitor connected between the positive and negative power supply paths;

a motor rotation control section configured to control the servomotor based on slide motion information and the driving power supply voltage, the slide motion information including information for controlling the servo motor to drive the slide;

a mechanism configured to convert a rotational motion of the servomotor into a linear motion to drive the slide;

a drive power supply voltage calculation unit configured to calculate the drive power supply voltage between the positive power supply path and the negative power supply path in accordance with the slide motion information;

an induced voltage calculation unit configured to calculate an induced voltage of the servomotor in accordance with the slide motion information;

a low-voltage state determination unit configured to determine whether or not the calculated drive power supply voltage at a predetermined timing is lower than the calculated induced voltage corresponding to the drive power supply voltage; and an instruction output unit configured to output a modification instruction to modify the slide motion information when the low-voltage state determination unit has determined that the calculated drive power supply voltage is lower than the calculated induced voltage.

8. The servo-press machine as defined in claim 7, further comprising a unit configured to modify the slide motion information for reducing the induced voltage to a value lower than the drive power supply voltage.

9. The servo-press machine as defined in claim 8, wherein the unit modifies the slide motion information for reducing a rotational speed of the servomotor.

10. The servo-press machine as defined in claim 8, wherein the unit modifies the slide motion information for reducing an acceleration rate of the servomotor.

11. The servo-press machine as defined in claim 8, wherein the unit modifies the the slide motion information for delaying an acceleration start time of the servomotor.

12. The servo-press machine as defined in claim 8, wherein the unit modifies the slide motion information for decelerating a rotational speed of the servomotor.

13. A servo-press machine comprising:

a slide;

a servomotor for driving the slide for performing a press-forming operation;

a power supply device configured to provide a driving power supply voltage;

positive and negative power supply paths coupled to the power supply device;

a capacitor connected between the positive and negative power supply paths;

a motor rotation control section configured to control the servomotor based on slide motion information and the driving power supply voltage, the slide motion information including information for controlling the servo motor to drive the slide;

a mechanism configured to convert a rotational motion of the servomotor into a linear motion to drive the slide;

a drive power supply voltage detection unit a configured to detect the drive power supply voltage;

an induced voltage detection unit configured to detect the induced voltage of the servomotor;

a low-voltage state determination unit configured to determine whether or not the detected drive power supply voltage at a predetermined timing is lower than the detected induced voltage corresponding to the detected drive power supply voltage; and a control unit configured to automatically modify the slide motion information when the low-voltage state determination unit has determined that the detected drive power supply voltage is lower than the detected induced voltage.

14. The servo-press machine as defined in claim 13, further comprising a unit configured to modify the slide motion information for reducing the induced voltage to a value lower than the drive power supply voltage.

15. The servo-press machine as defined in claim 14, wherein the unit modifies the slide motion information for reducing a rotational speed of the servomotor.

16. The servo-press machine as defined in claim 14, wherein the unit modifies the slide motion information for reducing an acceleration rate of the servomotor.

17. The servo-press machine as defined in claim 14, wherein the unit modifies the slide motion information for delaying an acceleration start time of the servomotor.

18. The servo-press machine as defined in claim 14, wherein the unit modifies the slide motion information for decelerating a rotational speed of the servomotor.

* * * * *